United States Patent [19]

Kitamura et al.

[11] Patent Number: 4,855,122

[45] Date of Patent: Aug. 8, 1989

[54] METHOD FOR PRODUCING CHOPPED STRANDS OF CARBON FIBERS

[75] Inventors: Tadanori Kitamura; Hiroaki Shono; Atsuki Kodama, all of Fukushima, Japan

[73] Assignees: Nitto Boseki Co., Ltd.; Kawasaki Steel Corporation, both of Japan

[21] Appl. No.: 293,571

[22] Filed: Jan. 3, 1989

Related U.S. Application Data

[63] Continuation of Ser. No. 58,377, Jun. 5, 1987, abandoned.

[30] Foreign Application Priority Data

Jun. 16, 1986 [JP] Japan ..... 61-139772

[51] Int. Cl.[4] ..... D01F 9/12; C10L 3/02

[52] U.S. Cl. ..... 423/447.1; 423/447.2; 423/447.4; 423/450; 264/29.2; 264/29.7

[58] Field of Search ..... 423/447.1, 447.2, 447.4, 423/447.9, 449, 450; 264/29.2, 29.7

[56] References Cited

U.S. PATENT DOCUMENTS

| | | | |
|---|---|---|---|
| 3,852,428 | 12/1974 | Powell et al. | 264/29 |
| 3,976,729 | 8/1976 | Lewis et al. | 423/447.8 |
| 4,026,788 | 5/1977 | McHenry | 208/39 |
| 4,234,650 | 11/1980 | Schieber | 423/447.1 |
| 4,259,307 | 3/1981 | Maruyama | 264/29.2 |
| 4,275,051 | 6/1981 | Barr | 423/447.4 |
| 4,284,615 | 8/1981 | Maruyama | 423/447.1 |
| 4,303,631 | 12/1981 | Lewis et al. | 208/39 |
| 4,431,623 | 2/1984 | Fug | 264/29.2 |
| 4,490,201 | 12/1984 | Leeds | 423/447.1 |
| 4,500,328 | 2/1985 | Brassell | 55/97 |
| 4,506,028 | 3/1985 | Fukuda et al. | 423/449 |
| 4,571,317 | 2/1986 | Layden, Jr. et al. | 264/29.2 |
| 4,575,411 | 3/1986 | Uemura et al. | 423/447.4 |
| 4,582,662 | 4/1986 | Koga et al. | 423/447.6 |
| 4,610,860 | 9/1986 | Mullen | 264/29.2 |
| 4,619,796 | 10/1986 | Awata et al. | 423/447.6 |
| 4,656,022 | 4/1987 | Uemura et al. | 423/447.2 |
| 4,686,096 | 8/1987 | Schulz et al. | 423/447.2 |
| 4,781,908 | 11/1988 | Hara et al. | 423/447.1 |

*Primary Examiner*—Anthony McFarlane

*Attorney, Agent, or Firm*—Wegner & Bretschneider

[57] ABSTRACT

Disclosed is a method for producing carbon fiber chopped strands excellent in bundling of fibers, high in bulk density, uniform in fiber length and superior in molding operability which includes application of an inorganic and/or organic binder in an amount of 0.1–3% by weight in terms of solid to carbon fiber or graphite fiber strands or chopped strands made from a petroleum or coal pitch.

3 Claims, No Drawings

METHOD FOR PRODUCING CHOPPED STRANDS OF CARBON FIBERS

This application is a continuation of U.S. application Ser. No. 058,337, filed June 5, 1987, now abandoned.

BACKGROUND OF THE INVENTION

This invention relates to a method for producing carbon fiber chopped strands.

Main uses of PAN (polyacrylonitrile) carbon fibers and pitch carbon fibers are space vehicle materials, sliding members, cement reinforcing materials, etc. If it becomes possible to reduce cost by improvement of techniques for production of carbon fibers, it can be expected that these fibers can be further used in automobile field.

It should be noted that except for use in space vehicle field, mostly, these fibers are produced by cutting and chopping long carbon fibers or tow carbons fibers to a specific length (for example, 1–25 mm).

However, with reference to PAN carbon fibers, they are on the market in the form of well bundled short and thin chopped strands, but with reference to pitch carbon fibers, they have not yet been made in the form of chopped strands having properties satisfactory for molding operation and for uniform dispersion and good in orientation and bundling of fibers.

This invention relates to a method for easy production of carbon fiber chopped strands excellent in molding operability and low in transport cost due to high bulk density.

Hitherto, chopped strands have been produced from pitch carbon fibers by infusing and carbonizing pitch fibers spun in the form of short cotton by centrifugal spinning method or turbulence spinning method, then making them into tow by carding and thereafter cutting the tow to a suitable length.

However, chopped strands made by such methods are not only ununiform in fiber length, but are difficult to form into a dense structure with fibers being arranged in a specific direction and satisfactorily oriented, and a cotton-like structure of high bulkiness is formed.

Therefore, even if a binder is applied to the above-mentioned tow and thereafter the tow is cut, it becomes totally or partially cotton-like and it is impossible to obtain chopped strands of 0.2 g/cm$^3$ or higher in bulk density.

Owing to this high bulkiness, there have been problems such as high transport cost, and severe troubles in production of molding materials such as inferior operability in blending with resins and molding.

SUMMARY OF THE INVENTION

According to this invention, the inferior molding operability due to the cotton-like high bulkiness of chopped strands of pitch carbon fibers has been solved by forming chopped strands of a dense structure having a bulk density of 0.2–0.8 g/cm$^3$ by application of a suitable amount of a binder by a suitable method.

There are the following two methods preferable for production of chopped strands of carbon fibers of this invention which have high bulk density with the fibers being excellently bundled and oriented, have uniform fiber length and are superior in molding operability:

(1) Petroleum or coal pitch is spun and bundled to obtain strand-like pitch fibers, these strand-like fibers are cut to a specific desired length of 1–50 mm and then made infusible and are carbonized in a high density accumulation state to obtain chopped strands of carbon fibers, an inorganic and/or organic binder is applied to thus obtained chopped strands so that 0.1–3% by weight in terms of solid of the binder adheres to the strands and then thus treated chopped strands are dried.

(2) Said pitch fibers to which a solid lubricant has been applied are made infusible and are carbonized to obtain strands of carbon fibers, then, an inorganic and/or organic binder is applied to said strands so that 0.1–3% by weight in terms of solid of the binder adheres to the strands and then thus treated strands are cut to chopped strands of a desired length of 1–50 mm.

Chopped strands of carbon fibers of good properties can be obtained by any of these two methods. However, considering that the pitch fibers are extremely fragile and meticulous care is required for handling of them, the method (1) according to which pitch fibers as formed are immediately made into chopped strands is especially preferred and carbon filter chopped strands can be produced inexpensively and easily without any troubles.

The above preferable methods are more specifically explained below.

To pitch fibers just after melt spun from a nozzle of 30–4,000 holes is applied a suitable bundling agent such as containing a low boiling solvent, e.g., water or methanol or a solid lubricant, e.g., molybdenum disulfide, tungsten disulfide, talc or graphite, then the fibers are accumulated by a bundling roller and immediately thereafter are cut by a cutting device to 1–50 mm, preferably 1–25 mm to make chopped strands. These chopped strands at an accumulation density of up to about 0.7 g/cm$^3$ are made infusible by heating at a heating rate of 0.5°–10° C./min and keeping them in an oxidizing atmosphere at 280°–350° C. for about 0–30 minutes and then carbonized by heating at a rate of 5°–100° C./min and keeping them at 800°–3,000° C. (carbonization; graphitization) for less than 30 minutes.

Thus obtained chopped strands of carbon fibers which keep an appearance of bundled state are dipped in an inorganic and/or organic binder solution adjusted to such concentration that the binder adheres to the strands in an amount of 0.1–3% by weight in terms of solid and then are dried to obtain chopped strands of carbon fibers having a bulk density of 0.2–0.8 g/cm$^3$ and good in bundling property.

In addition to the above-mentioned methods, the desired chopped strands of carbon fibers can also be produced by applying said bundling agent to pitch fibers, bundling them by bundling rollers, accumulating the pitch fiber bundle in a basket at an accumulation density of 0.05 g/cm$^3$ or less by an air sucker, then subjecting them to infusibilization and carbonization under the same conditions as above to obtain strands of carbon fibers, applying an inorganic and/or organic binder in an amount of 0.1–3% by weight in terms of solid to thus obtained strands by roller coater, etc., drying them, thereafter, cutting them to the above-stated length by a cutting device to obtain chopped strands of carbon fibers having a bulk density of 0.2–0.8 g/cm$^3$ and good bundling property.

As raw materials for the chopped strands of carbon fibers of this invention, there may be used either of optically isotropic or optically anisotropic pitch to obtain the chopped strands of good bundling property and high bulk density.

A wide variety of binders may be used irrespective of whether they are inorganic or organic as long as they have a certain degree of bonding property and the binders are selected depending on uses of the chopped strands. Typical examples of inorganic binders are silicates, phosphates, colloidal silica, etc. and those of organic binders are polymeric emulsions such as polyvinyl acetate emulsion, polyacrylic emulsion, polyester emulsion, epoxy emulsion, etc., phenolic resin solution, synthetic rubber solution, natural materials such as gelatin, gum arabic, etc.

Amount of said binders adhering to the chopped strands of carbon fibers must be within the range of 0.1–3% by weight in terms of solid.

When the adhering amount is less than 0.1% by weight, splitting of strands tends to occur during cutting operation or by a shock and the strands cannot maintain the well arranged and bundled state of 0.2–0.8 g/cm$^3$ in bulk density and thus, such strands are inferior in molding operability and are difficult to handle as molding materials.

When the adhering amount is more than 3% by weight, further increase in bundling effect is not seen and industrial significance and economical advantages are lost and besides, dispersibility in cement or plastics is somewhat reduced to lose improvement in reinforcing effect.

The following nonlimiting examples further illustrate this invention.

EXAMPLE 1

An optically anisotropic pitch was made into pitch fibers of 13μ in fiber diameter by a spinning apparatus having a nozzle of 2,000 holes. Thus obtained pitch fibers were bundled with a 5 wt % dispersion of graphite and then cut by a continuous cutting apparatus to make pitch fiber chopped strands of 6 mm in length.

The resulting chopped strands at an accumulation density of 0.7 g/cm$^3$ were heated in the air at a heating rate of 3° C./min and kept at 320° C. for 30 minutes to make them infusible and subsequently, heated to 1,000° C. at a heating rate of 5° C./min in a nitrogen atmosphere and kept at that temperature for 30 minutes to carbonize them.

Thus obtained carbon fiber chopped strands of apparently good orientation and bundling state were dipped in an epoxy emulsion of 1% by weight in concentration, followed by removing the epoxy emulsion by decantation method and then the strands were dried at 120° C. for 60 minutes.

The resulting carbon fiber chopped strands contained 1% by weight of the epoxy binder which adhered to the strands, had good bundling with the same uniform fiber length and arranged in the same direction and had a bulk density of 0.7 g/cm$^3$.

EXAMPLE 2

An optically isotropic pitch was made into pitch fibers of 13μ in fiber diameter by a spinning apparatus having a nozzle of 2,000 holes. Thus obtained pitch fibers were bundled with a 5 wt % dispersion of graphite and then were accumulated at an accumulation density of 0.05 g/cm$^3$ in a stainless steel basket by an air sucker. The accumulated fibers were heated at a heating rate of 1° C./min in the air and kept at 300° C. for 30 minutes to make infusible them and successively heated to 1,000° C. at a heating rate of 10° C./min and kept at this temperature for 30 minutes to carbonize them.

To thus obtained carbon fiber strands was applied an aqueous sodium silicate solution by a roller coater so that amount of the binder which adhered to the strands was 1.2% by weight in terms of solid, followed by drying at 100° C. for 60 minutes. Thereafter, the strands were cut to make carbon fiber chopped strands of 3 mm in length.

Thus obtained chopped strands were added in an amount of 2.5% by weight to a normal Portland cement and this cement was kneaded by an Ommi-Mixer of 10 l to make a reinforced cement material.

Thus obtained molding material had a flexural strength of 720 Kg/cm$^2$.

No scattering of carbon fibers occurred during the kneading operation and operability was excellent.

EXAMPLE 3

Carbon fiber chopped strands were produced in the same manner as in Example 1 except that an optically isotropic pitch was used as spinning raw material and infusion was carried out by heating the chopped strands at a heating rate of 1° C./min and keeping them at 300° C. for 30 minutes.

Thus obtained carbon fiber chopped strands were dry-blended in an amount of 20% by weight with ABS resin and the blend was fed to an extruder.

The carbon fiber chopped strands were not split at all by the dry-blending operation and could be smoothly charged into a hopper and forced-feeding was smoothly accomplished.

Comparative Example 1

Short cotton-like optically isotropic pitch fibers made by centrifugal spinning method were heated at a heating rate of 1° C./min and kept at 300° C. for 30 minutes in the air to make infusible them and successively heated to 1,000° C. at a heating rate of 5° C./min and kept at this temperature for 30 minutes in a nitrogen atmosphere to carbonize them.

Thus obtained short cotton-like carbon fibers were subjected to carding to make a silver, which was applied with an epoxy resin emulsion so that amount of the binder which adhered to the silver was 2% by weight in terms of solid and, after drying, was cut to 3 mm in length to obtain chopped wool.

Bulk density of this chopped wool was low, namely, 0.11 g/cm$^3$ and even the observation with the naked eye revealed that the fiber length was uneven and the fibers had wave.

The chopped wool was dry-blended in an amount of of 20% by weight with ABS resin to cause splitting of fibers in the cotton-like form with partial formation of pills. This was introduced into an extruder, but could not be forced into screw and could not be pelletized.

Comparative Example 2

Carbon fiber chopped strands of 3 mm in fiber length were produced in the same manner as in Example 1. They were dipped in a polyester resin emulsion of 1% by weight in concentration and excess liquid was removed by decantation method, followed by drying at 120° C. for 60 minutes to obtain carbon fiber chopped strands having 0.08% by weight of the binder adhering thereto.

When the chopped strands were dry-blended with ABS resin in the same manner as in Comparative Example 1, the chopped strands were filamentarily split during the blending to produce pills and could not be forced into screw and could not be pelletized.

Comparative Example 3

Carbon fiber chopped strands of 3 mm in fiber length made in the same manner as in Example 1 were dipped in a polyurethane emulsion of 4.5% by weight in concentration and excess emulsion was removed by decantation method, followed by drying at 120° C. for 60 minutes to obtain carbon fiber chopped strands having 4.1% by weight of the binder adhering thereto.

The chopped strands were then dry-blended in an amount of 30% by weight with 6-nylon and fed to an extruder to pelletize them.

Operability was good except that there was recognized some unsatisfactory dispersion of carbon fibers in pellets.

However, the chopped strands after application of 4.1% by weight in terms of solid of polyurethane and before drying were sticky and operability of drying was not good.

Furthermore, no superiority was seen in molding operation to those in Examples 1–3.

The carbon fiber chopped strands of this invention which comprise fibers to which 0.1–3% by weight in terms of solid of an inorganic or organic binder adheres and which are oriented in one direction, have a uniform length, are good in bundling property and have a bulk density of 0.2–0.8 g/cm$^3$ can be reduced in transport cost because of high bulk density and are markedly improved in operability in pelletization of thermoplastic composite materials when they are used as reinforcing materials for cement materials or reinforced composite materials because of superior bundling property.

What is claimed is:

1. A method for producing chopped strands of carbon fibers having a bulk density of 0.2–0.8 g/cm$^3$ which comprises spinning a petroleum or coal pitch into continuous pitch fibers, bundling and cutting thus obtained pitch fibers to a length of 1–50 mm and then subjecting the fibers to infusibilization, and then carbonization or graphitization, and then applying an inorganic or organic binder to the resulting chopped strands of carbon fibers or graphite fibers so that 0.1–3% by weight in terms of solid of the binder adheres to the strands.

2. A method according to claim 1 wherein the binder is an emulsion or solution of an organic binder.

3. A method according to claim 1 wherein the binder is an aqueous solution or colloid of an inorganic binder.

* * * * *